US005711525A

United States Patent [19]

Breeding

[11] Patent Number: 5,711,525

[45] Date of Patent: Jan. 27, 1998

[54] METHOD OF PLAYING A WAGERING GAME WITH BUILT IN PROBABILTY VARIATIONS

[75] Inventor: John G. Breeding, Eden Prairie, Minn.

[73] Assignee: Shuffle Master, Inc., Eden Prairie, Minn.

[21] Appl. No.: 778,115

[22] Filed: Jan. 2, 1997

Related U.S. Application Data

[63] Continuation of Ser. No. 602,704, Feb. 16, 1996, abandoned.

[51] Int. Cl.[6] ..... A63F 1/00

[52] U.S. Cl. ..... 273/292

[58] Field of Search ..... 273/292, 303, 273/305, 274

[56] References Cited

U.S. PATENT DOCUMENTS

| | | | |
|---|---|---|---|
| 4,836,553 | 6/1989 | Suttle et al. . | |
| 4,948,134 | 8/1990 | Suttle et al. . | |
| 5,022,653 | 6/1991 | Suttle et al. . | |
| 5,100,137 | 3/1992 | Fulton . | |
| 5,167,413 | 12/1992 | Fulton . | |
| 5,251,897 | 10/1993 | Fulton . | |
| 5,288,077 | 2/1994 | Jones . | |
| 5,364,104 | 11/1994 | Jones et al. . | |
| 5,364,105 | 11/1994 | Jones . | |
| 5,374,067 | 12/1994 | Jones . | |
| 5,377,973 | 1/1995 | Jones et al. . | |
| 5,380,012 | 1/1995 | Jones et al. . | |
| 5,382,025 | 1/1995 | Sklansky et al. . | |
| 5,393,067 | 2/1995 | Paulsen et al. | 273/292 |
| 5,407,209 | 4/1995 | Prerost | 273/292 |
| 5,411,257 | 5/1995 | Fulton . | |
| 5,452,899 | 9/1995 | Skratulia | 273/292 |
| 5,486,005 | 1/1996 | Neal | 273/292 |
| 5,489,101 | 2/1996 | Moody | 273/292 |
| 5,511,781 | 4/1996 | Wood et al. | 273/292 X |
| 5,577,731 | 11/1996 | Jones . | |
| 5,584,485 | 12/1996 | Jones et al. . | |

*Primary Examiner*—William E. Stoll
*Attorney, Agent, or Firm*—Craig J. Lervick

[57] ABSTRACT

A wagering card game is disclosed in which the player makes an initial bet to participate in a base game. Prior to the play of the game, the dealer will display at least one additional card from the deck. After viewing this card or cards, the player is given the opportunity to place an additional wager which would qualify the player for an additional winning. By giving the player the opportunity to see at least one card in the deck, considerable insight is provided into the probabilities of certain hands being created. The game of the present invention utilizes a variation on standard card games which are easily understood and which do not involve considerable training and education of the players.

33 Claims, 3 Drawing Sheets

METHOD OF PLAYING A WAGERING GAME WITH BUILT IN PROBABILTY VARIATIONS

This is a continuation of prior application Ser. No. 08/602,704, filed Feb. 16, 1996, now abandoned.

BACKGROUND OF THE INVENTION

The present invention related to a method of playing a wagering game utilizing a standard deck of playing cards. During the process of the game, the player is given the opportunity to view at least one additional card not in play, thus favorably altering their wagering strategies. Following the disclosure of at least one additional card the player is given the opportunity to place an additional wager on the outcome of the game. The present method and game is a variation on the game of poker utilizing hands of well known poker rank.

Many different wagering games presently exist for use in both home and casino environments. Such games should necessarily be exciting, uncomplicated and easy to learn so as to avoid frustrating the players. Games such as poker have gained widespread popularity because of their established ranking of hands and well known rules. Furthermore, standard poker games usually involve numerous wagering opportunities for the players thus increasing player participation and excitement. Lastly, the hands move fairly quickly to maintain action and activity. All of these factors have created a game which is widely accepted and widely known.

Wagering games are described in many publications, such as U.S. Pat. No. 5,288,081 which discloses a variation of the well known game of five card stud poker. U.S. Pat. No. 5,288,081, entitled "Method of Playing a Wagering Game", is assigned to the assignee of the present invention and is herein incorporated by reference. This patent discloses a method of playing a poker game which involves placing a multi-part wager and then being allowed to withdraw a portion of the wager. Such control over portions of the wager increases player participation and enjoyment.

Similarly, other variations in wagering structures can also increase the excitement and acceptance of such wagering games. U.S. Pat. No. 5,417,430 discloses a poker game with an altered wagering scheme thus allowing the player the opportunity to compete for an additional prize or payout. U.S. Pat. No. 5,417,430 is also assigned to the assignee of the present invention and also herein incorporated by reference.

Further wagering games are disclosed in U.S. Pat. Nos. 5,861,041 and 5,087,405 (both to Jones et al.) which both disclose a progressive jackpot game. U.S. Pat. No. 4,836,553 (to Suttle and Jones) disclose a modified five card stud poker game.

Other variations can be made to standard games to allow more player opportunity and involvement. U.S. Pat. No. 5,098,107 discloses a game wherein additional symbols are added to increase wagering opportunities. This allows the player the opportunity to place several wagers on different portions of the game while the game is being played. Somewhat similarly, U.S. Pat. No. 3,667,757 discloses a board game wherein the player is given choices regarding alternative strategies for play. Naturally the different strategies chosen have different payoff results. Unfortunately, this game is somewhat complicated and requires a considerable amount of time for the players to learn.

In addition to the above mentioned characteristics, it is also often desirable to provide players with strategic information which will assist them in the play of the wagering game. For example, during the play of standard poker, it is always desirable to know any information regarding the probability of receiving certain cards in your hand. Alternatively, it is beneficial to know the probability of certain cards existing when dealt face down. For example, in the aforementioned U.S. Pat. No. 5,288,081, when deciding whether to withdraw a portion of the player's wager, it would be beneficial for the player to have some information related to the probability of them attaining a winning hand. This additional information would cause a player to feel more in control of their wagers. Therefore, the receipt of any additional information relative to the probabilities of attaining a winning hand will increase the player's enjoyment and excitement while playing the wagering game.

In summary, it is desired to find a game that is easy to play and also fast moving. When the player is provided with a considerable amount of participation, allowing them to make choices based on the sequence of play, these games become much more strategic and enjoyable. Furthermore, a game is more exciting if a player feels he has been provided with sufficient information to judge the probabilities of different outcomes.

SUMMARY OF THE INVENTION

The wagering game of the present invention involves a variation of standard five card poker. The game is played with a standard fifty-two card poker deck and generally involves the rules and wager resolution common to standard five card poker. Furthermore, a side bet opportunity is provided which is played against a payout schedule and not against specific players or a dealer's hand. This type of playing configuration creates an anonymous, faceless game whereby personalities will not become an issue.

To begin the game, each player makes a wager. This wager can be the standard wager placed to participate in some base game. For example, the base game may include poker of many different types. Following the placement of the base wager the cards are dealt to the players and to the dealer. Following the deal, the dealer reveals one or more cards and shows them to the players. These cards will be chosen from the remainder of the playing deck. At this point, the players are now provided the opportunity to place a side bet which could qualify them for additional winnings. This side bet will provide winnings to the players based on a schedule of hands with corresponding winning amounts. The side bet must be placed, however, prior to the player's examining their cards.

As one or more cards have been shown to the players, the players will have additional information regarding the probabilities of certain hands being established. This information will benefit the players as they are contemplating the placement of the side bet. In one embodiment of the invention, this side bet opportunity will be played along with standard five card stud poker. Alternatively, in a second embodiment, the side bet opportunity could be played along with the five card poker game as described in U.S. Pat. No. 5,288,081.

Following the players' opportunity to place a side bet, the players will examine their cards and proceed with the base game. The base game is then played until resolution and all bets are resolved following play. These bets will be resolved according to the respective payout schedules or practices for the base game and the schedule for the side bet.

In the second embodiment of the game, the player begins by making a wager consisting of three parts. The cards are then dealt such that each player is given three cards face down and the dealer is dealt two cards, also face down. The object is to obtain a favorable poker hand utilizing the three dealt cards and the two dealer or community cards, which will be shown at a later time.

Following the deal, the dealer will then flip one card from the deck and show this card to the players. Alternatively, more cards could be shown to the players. This card is subsequently discarded or taken out of play. The players are now given the opportunity to place a side bet which would qualify them for an additional winning amount. The players can make this determination based on the one or more revealed cards. At this point, the player has not examined their three dealt cards. Alternatively, the three player's cards are not dealt until after the players have the opportunity to place their side bets.

Play of the base game now continues by each player being allowed to examine the three cards dealt to them to assess the possibility of attaining a winning poker hand. The dealer will then ask the players whether they would like to remove a first portion of their wager or "let it ride" (Take it or leave it?). After inquiring of all the players whether the first portion of their bet will be withdrawn or not, the dealer then flips over a first dealer or community card. At this point, each player now knows four of the five cards making up their hand and will have some indication as to whether a favorable poker hand can be produced. Play will continue when the player is questioned regarding the second portion of their wager, whether they want to remove it or "let it ride?". Following the opportunity for each player to remove a second portion of their wager, the dealer then flips the second community card. A five card poker hand is now created utilizing the three dealt cards and the two community cards which are now flipped face up and known to all players.

Now that all of the community cards have been flipped up, the players turn over their three dealt cards to reveal the poker hands held by each player. All wagers are then settled according to schedules. Payouts are made to all players with winning hands, while wagers for those players with losing hands are collected. Following the resolution of all wagers, the cards are then shuffled and readied for the next hand.

The present wagering game can be played on a standard well known gaming table. Alternatively, the game can be played on any type table or playing surface as is desired.

As will be recognized from the above recited steps, the game of the present invention allows an exciting and unique opportunity for the player to control many portions of their wager. Furthermore, by disclosing the existence of at least one additional card early in the play of the game, the players are given additional information upon which to make their wagering decisions. Consequently, players are likely to feel in greater control of the outcome of their wagers. This disclosure of an additional card will greatly affect the probabilities that the undisclosed card or cards will eventually create a favorable hand.

It is an object of the present invention to provide an exciting wagering type game which is easily understandable by the players. One aspect of this object involves the playing of a wagering game which utilizes standard playing cards and standard poker hands.

It is another object of the present invention to provide a side bet opportunity for players where large payouts are possible. This side bet opportunity is provided at a time when the player has received some information regarding the probabilities of certain hands.

It is a further object of the present invention to provide a wagering game wherein information is provided to the players throughout the game so as to easily allow them to make wagering decisions based on such information. In this way, the player has additional information related to the probabilities of certain hands.

It is another object of the present invention to provide a wagering game in which play moves fairly quickly and wagering is easily resolved.

DETAILED DESCRIPTION OF THE DRAWINGS

The above mentioned objects will be more fully understood when read in conjunction with the following detailed descriptions and drawings in which.

DETAILED DESCRIPTION OF THE PREFERRED EMBODIMENT

Figure 1:
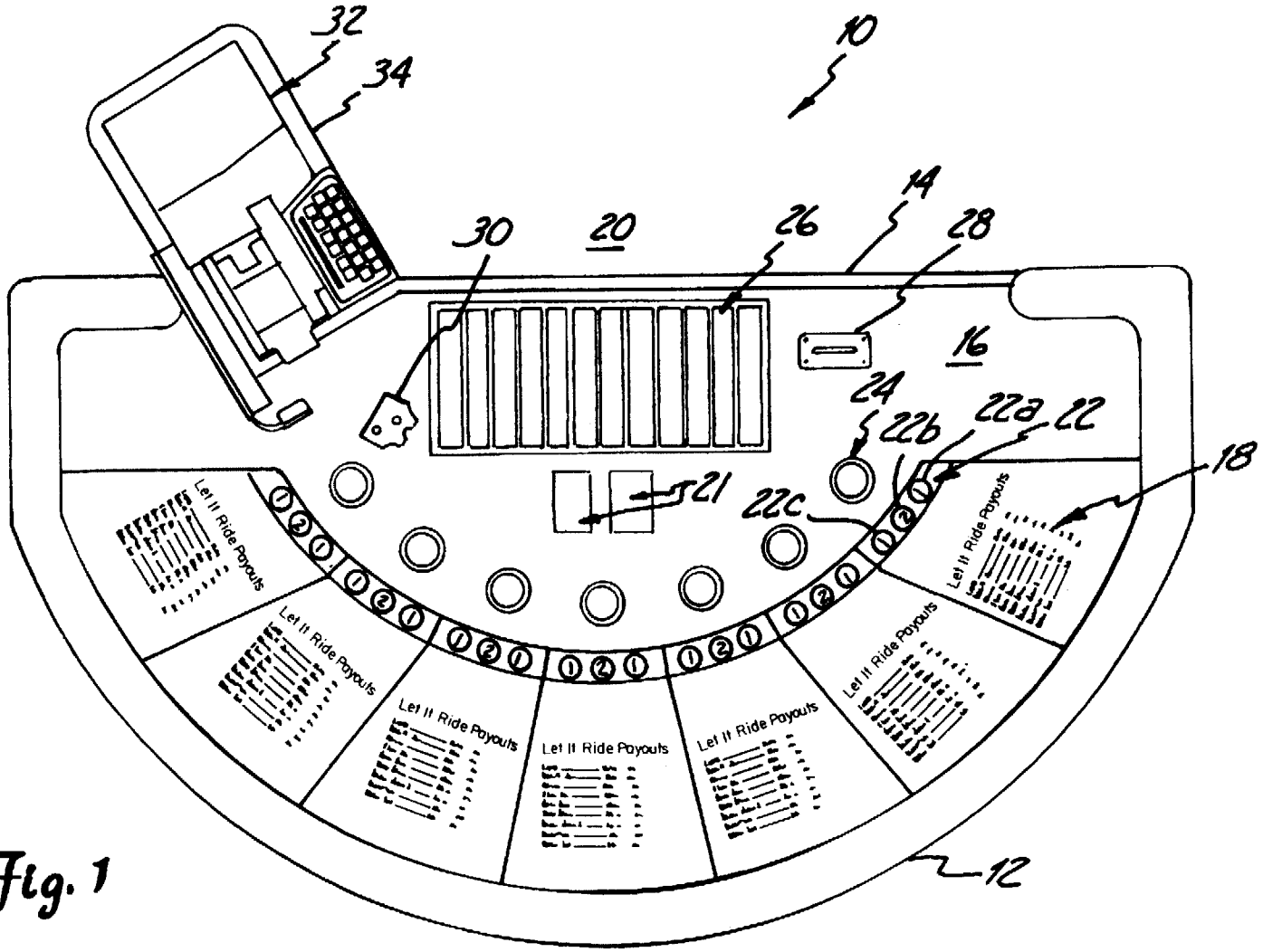
FIG. 1 is the top view of a gaming table for use in carrying out the method of the present invention.

Referring now to FIG. 1, there is shown a typical gaming or wagering table 10 for use in carrying out the process of playing the present wagering game. Table 10 is typical of those gaming tables seen in casinos throughout the United States and other countries. Table 10 has a curved side 12 for accommodating a number of players along with a straight side 14 along which is typically positioned a dealer. Curved side 12 accommodates a number of players for the present wagering game. As shown, there are seven playing locations 18 shown on the table. Each of the playing locations 18 is located on a flat upper surface 16 of the gaming table 10. A dealer position 20 is located at the center of the table at straight side 14. From here the dealer can easily access the wagers and cards of all the players positioned at curved side 14 of table 10. Also shown on table 10 are areas for displaying the dealer's cards 21 and a wagering zone 22 corresponding to each player location 18. Each wagering zone includes an area for three wagers (22*a*, 22*b* and 22*c*).

At one side of dealer station 20 there is shown a shuffling machine 32 supported by table extension 34. Shuffling machine 32 may be of the type disclosed in U.S. Pat. No. 4,807,844, disclosure of which is incorporated herein by reference. Although not essential to the playing of the game of the present invention, shuffling machine 32 may provide to be extremely helpful in speeding along the pace of the game.

On flat upper surface 16, there are also a number of side bet wagering zones 24. Each of these side bet wagering zones 24 provide a place for the players to place side bets when desired. Also on flat upper surface 16 are a chip tray 26, a money drop slot 28 and a discard rack 30.

Figure 2:
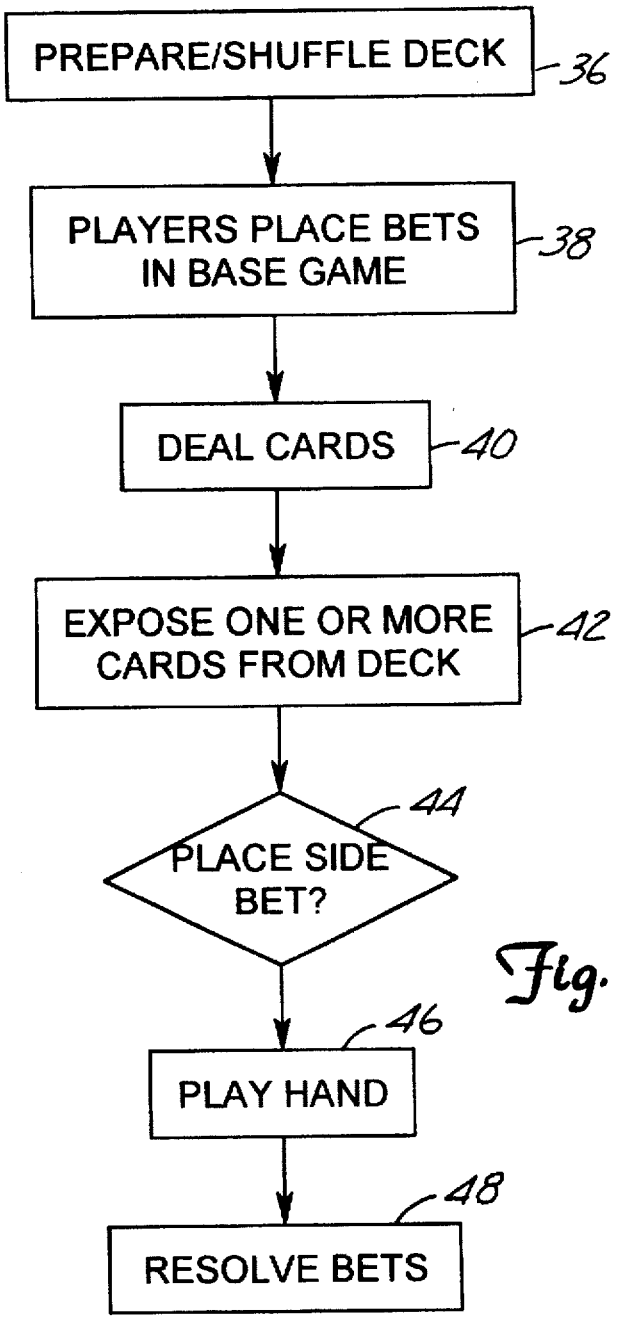
FIG. 2 is a flow chart outlining the steps of the present wagering game.

Referring now to FIG. 2, there is shown a flow chart outlining the steps of the present invention. The game starts by the dealer preparing or shuffling cards 36 in any well known manner. This could include the use of automatic shuffler 32, hand shuffling or any other appropriate shuffling methods. To begin play, each player places a bet in the base game 38. The base game contemplated by the present invention could include any number of games. The present invention will be described in the context of five card stud poker; however, it is understood that other games could be altered for use with the present invention. Games contemplated as part of the invention are of the type wherein cards are dealt making up the player's hand, additional cards are exposed to the players and the players are then given the opportunity to place a side bet (prior to the player examining their cards).

In step 40 the cards are dealt to both the dealer and the player. Next, in step 42, the dealer exposes one card from the deck, shows this card to the players and then discards this card. Alternatively, more than one card could be revealed. This step of revealing additional cards will provide the player with additional information related to the probability of certain hands developing during the play of the base game. Additionally, this step will provide the player with information regarding the desirability of placing an additional wager. Next, in step 44, the player is given the opportunity to place an additional side bet which will provide the opportunity to win additional amounts depending on the outcome of the game. The player must, however, place this side bet prior to examining their cards. The preferred embodiment of this side bet opportunity will pay the player additional amounts upon receiving certain hands. For example, a grand prize side bet amount may be paid to the player after their side bet is placed and their hand produces a royal flush. This amount may vary widely depending on a number of conditions including number of participants, desired profit levels, etc.

The play of the base game then continues 46 until completion. Following completion of the base game, all bets are resolved 48 according to the well understood rules of play. The wager placed for playing the base game will be resolved according to the rules of the base game while the side bet will be resolved according to a second schedule. For example, the side bet schedule could include:

| Hand | Side Bet Payout |
|---|---|
| Royal Flush | $20,000.00 |
| Straight Flush | $2,000.00 |
| Four of a Kind | $200.00 |
| Full House | $100.00 |
| Flush | $50.00 |
| Straight | $25.00 |

It will be understood that the payout schedule could take on many forms, depending upon the nature of the base game. As is common in the gaming industry, payouts are calculated such that expenses of providing the game to a player over a long period of time is paid out of wagers along with an accepted profit amount. The remaining amounts of the collected wagers are then used to calculate the winnings. All of these amounts typically are calculated to work out over a long period of time, however, deficits may occur for short periods of time (i.e. more may be paid out than is received).

Figure 3:
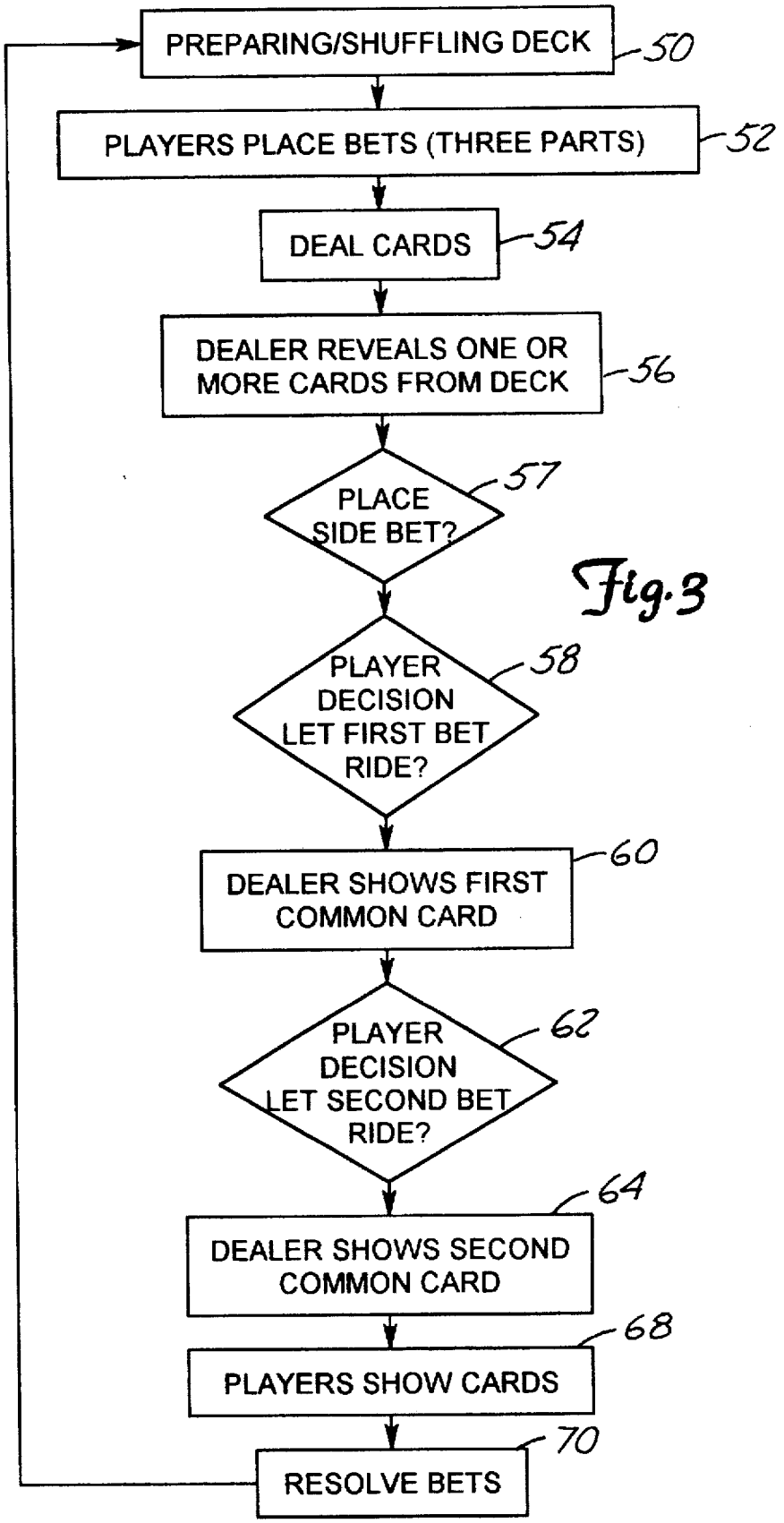
FIG. 3 is a flow chart outlining a second embodiment of the present invention.

Referring now to FIG. 3, there is shown a flow diagram outlining the steps involved in playing a second embodiment of the present wagering game. This second embodiment involves playing the game of the present invention in conjunction with the game outlined in U.S. Pat. No. 5,288,081. This wagering game begins at step 50 wherein the deck of cards is prepared and shuffled. This step may involve hand shuffling the cards, the use of automatic shuffler 32, and/or any appropriate cutting of the deck by the player. As the cards are shuffled and prior to the commencement of the wagering game, the player is given the opportunity to place bets on the base game. In step 52, the player places wagers or bets for the base game in wagering zone 22. In this game, the wagers are divided into three equal parts and placed in wagering zones **22*a*, 22*b* and 22*c*. Next, in step 54 the cards are dealt, with three cards to each player, face down, and two cards to the dealer, also face down. Following the deal of the cards, each player has three cards which are not yet examined at this time. The dealer has two cards dealt face down in area 21**. These cards are not examined or reviewed by anyone at this time.

After dealing cards 54, the dealer then will show one or more additional cards from the deck in step 56. This may be the top card or cards from the dealing deck or may also be any card which has not yet been dealt. The revealed card or cards are then discarded or removed from play. By showing one or more cards from the deck, the odds and probabilities of certain hands showing up in the player's hand may be greatly altered.

Now that the players have seen the one or more additional cards, they are given the opportunity to place a side bet 57. Side bet 57 provides a second wagering opportunity to bet that certain hands will be received. For example, in this second embodiment, the side bet could be a $1.00 bet placed in location 24 on table 10. Payouts on this side bet will be according to an established schedule of hands. The desirability of this side bet will depend partially upon the revealed cards. As will be recognized, the revealing of additional cards will provide the player with very useful information regarding this side bet opportunity.

Next, the player is given the opportunity to examine their dealt cards. The three cards dealt to each player, along with the two dealer or community cards which were dealt to the dealer, will make up the player's hand for this game. By combining the three dealt cards and the two community cards, a five card hand is created for use as a standard five card poker hand.

Following the review of the three dealt cards, a player will be asked whether they would like to remove a first portion of their wager (the wager placed in area **22*a*) or leave it ("let it ride"). This is shown as decision point 58 in the flow chart of FIG. 3**. Essentially the player is asked whether they would like to remove that portion of their wager from play at that point in time.

After everyone at the table has been given a chance to leave their wager in play ("let it ride") or remove the wager, the dealer will then show a first community card. (Step 60.) At this point, the player will now know four cards in his hand including the three dealt cards and the first community card. Consequently the only unknown card making up his poker hand will be the second community card which has not yet been overturned. Also, the player has also seen one or more cards revealed from the deck which are no longer in play.

Next, in step 62, each player is given the opportunity to withdraw a second portion of their wager. By now the player has seen four cards making up his five card poker hand and has also seen an additional card from the deck. Based on this information, each player will be asked whether they would like to leave the second portion of their wager in play ("let it ride") or would like to remove it. After each player has been given the opportunity in step 62 to remove or leave the second portion of their wager, the dealer will then show the second community card in step 64. At this point, the player will now know all five of the cards making up that player's poker hand. The game then moves on to step 68 where all players will reveal their dealt cards by overturning them. Lastly, in step 70 all bets are resolved according to the hand each player has obtained, the amount of their remaining wagers, and a payment schedule. Further, the side bet may be paid according to a second payout schedule.

The award or payoff given to each player in the basic game depends upon the amount of the bet that was allowed to ride (which will include at least the third non-withdrawable portion of the bet). Also, an additional payout will be made if the side bet was placed. An example of a payout schedule for both the basic game and the side bet could be as follows:

| Hand | Basic Game Payoff | Side Bet |
|---|---|---|
| Royal Flush | 1,000 to 1 | $20,000.00 |
| Straight Flush | 200 to 1 | $2,000.00 |
| Four of a Kind | 50 to 1 | $200.00 |
| Full House | 11 to 1 | $100.00 |
| Flush | 8 to 1 | $50.00 |
| Straight | 5 to 1 | $25.00 |
| Three of a Kind | 3 to 1 | $0.00 |
| Two Pairs | 2 to 1 | $0.00 |
| Pair (10s or better) | 1 to 1 | $0.00 |

As will be recognized, the disclosure of the additional card or cards from the deck in step 60 provides many advantages to those playing the game. First, the player will be given further insight into the possibilities of certain hands developing. For example, if a King of Spades is shown, the player now knows that a royal flush in spades nor four kings are possible hands. Further, the probability of receiving a large number of hands which include collections of kings or spades are greatly changed (e.g. full house with kings, straights, spade flushes, etc.).

Also, there now exists one less card in the deck from which a player's desired cards could have come. Thus, the probability that a desired card exists in the community cards increases accordingly.

As may be appreciated, the present game can be played with one or more players participating in the game. The game has been described in the context of a single player and a single dealer, however many players could participate in the game.

The method of the present invention may be altered in many ways to reach an equally exciting and challenging wagering game. For example, rather than disclosing a single card, a number of cards could be shown from the deck and thus discarded. Alternatively, a card could be initially shown and discarded even before the remainder of the cards are dealt. Many other combinations based on this theme are conceivable.

While the present method has been described in the context of a live casino table game, this method is equally applicable to other presentations. For example, the method of the present wagering game could be easily carried out by a video machine having a display and interactive buttons. In this embodiment, the video machine would have a video screen which would display one or more additional cards which are not in play. Following the display of additional cards, a player would be given the opportunity to place an additional wager on the outcome of the game. The player will then be shown their hand (or a portion thereof) and play will continue according to the rules of the game played.

Additionally, as other technologies become increasingly available, this game could be adapted for use in other arenas. One common example of this is the use of the present wagering game as a computer video game. This game could take the form of a CD ROM or computer diskette which is loaded into a standard personal computer. Further, the game could be incorporated into a hand held game system which would allow portable play in numerous different locations. Lastly, other types of installed computerized systems could be configured to carry out the method of the present game such as display systems on aircraft or busses etc.

Furthermore, enhancements could be included in the present game to create an entire game surrounding this concept. For example, certain hands could be designated as qualifying hands. When the second wager is placed and the player receives one of these qualifying hands, the player is then provided with an additional gaming opportunity. For example, all players who do place the second wager and then ultimately receive a royal flush in the play of the base game could be qualified to participate in a "winner's tournament" wherein all people who received these qualifying hands would be arranged at a single location to play for a large payout.

While the present game has been described in the context of a standard five card poker game, it is understood that the principles and ideas may be applied or used in other appropriate games. For example, the concepts are equally applicable to a seven card poker game as well.

The present invention has been described in considerable detail; however, it may be embodied in other forms without departing from the principles of the present invention. We claim all modifications within the scope and spirit of the following claims.

It is claimed:

1. A method of playing a wagering game using a deck of cards having a predetermined rank, comprising the steps of:

(a) a player placing a first wager to participate in a base game;

(b) a dealer dealing cards;

(c) the dealer intentionally displaying at least one card from the deck and discarding that card;

(d) the player placing a second optional wager after viewing the discarded card to simultaneously participate in a second wagering game;

(e) completing play of the base game; and (f) resolving the player's first and second wagers, based upon said players hand, resolution of the first wager being accomplished according to the standard rules of the base game while resolution of the second wager being accomplished according to a payout scheme.

2. The method of claim 1 wherein the base game is five card stud poker.

3. The method of claim 1 wherein the playing hand is a five card poker hand.

4. The method of claim 1 wherein the base game is seven card stud poker.

5. The method of claim 1 wherein the at least one additional card is the top card from the remainder of the deck.

6. The method of claim 1 further comprising the step of displaying at least one further additional playing card from the deck and discarding that card prior to the deal.

7. The method of claim 1 wherein the base game is five card draw poker.

8. The method of claim 1 wherein the at least one card is revealed from any location within the deck.

9. The method of claim 1 wherein the at least one card includes two or more cards.

10. The method of claim 1 wherein the payout scheme is a predetermined payout schedule.

11. The method of claim 1 wherein the payout scheme is progressive.

12. The method of claim 1 wherein the payout scheme is a predetermined payout schedule.

13. A method of playing a wagering game utilizing playing cards, comprising the steps of:

(a) players placing a wager consisting of a plurality of portions to participate in the game;

(b) dealing the cards such that each player receives a plurality of players cards and the dealer receives a plurality of community cards;

(c) intentionally revealing at least one additional card from the deck, disclosing the card to the players, and removing the additional card from play;

(d) allowing the player the opportunity to place a second, optional wager after viewing the revealed additional card;

(e) allowing the player to review the plurality of players cards;

(f) allowing the player the opportunity to remove a first portion of their wager based upon the reviewed players cards and the revealed additional card;

(g) revealing at least a first community card from the plurality of community cards;

(h) allowing the player the opportunity to remove a second portion of their wager based upon the reviewed players cards, the at least one revealed community card, and the revealed additional card;

(i) revealing the remaining community cards, thus creating a playing hand for each player by combining the community cards with the players cards; and (j) resolving the first wager based upon the player's playing hand and a first payout scheme and separately resolving the second wager based on the players hand and a second payment scheme.

14. The method of claim 13 wherein the cards dealt include three players cards and two community cards.

15. The method of claim 14 wherein the playing hand is a five card poker hand.

16. The method of claim 13 wherein the wager consists of three equal parts.

17. The method of claim 13 wherein the at least one additional card is the top card from the remainder of the deck.

18. The method of claim 13 further comprising the step of displaying at least one further additional playing card and discarding that card prior to the deal.

19. The method of claim 13 wherein the at least one additional card includes two cards.

20. The method of claim 13 wherein the first payment scheme is a predetermined schedule and the second payment scheme is a progressive jackpot.

21. The method of claim 13 wherein the first payout scheme is a first predetermined payout schedule and the second payout scheme is a second predetermined payout schedule.

22. A method of playing a wagering game utilizing cards, comprising:

(a) a player placing a wager to participate in a base game;

(b) a dealer dealing cards to the player and to the dealer;

(c) the dealer intentionally displaying at least one additional card from the deck and discarding the at least one card;

(d) a player placing an optional second wager after viewing the at least one discarded card;

(e) completing play of the base game;

(f) resolving the player's first wager by comparing the player's hand with the dealer's hand; and (g) resolving the player's second wager according to a payout scheme.

23. The method of claim 22 wherein the base game is five card stud poker.

24. The method of claim 22 wherein the base game is seven card stud poker.

25. The method of claim 22 wherein the at least one additional card is the top card from the remainder of the deck.

26. The method of claim 22 further comprising the step of displaying at least one further additional playing card and discarding that card prior to the deal.

27. The method of claim 22 wherein the base game is five card draw poker.

28. The method of claim 22 wherein the at least one card includes two or more cards.

29. The method of claim 22 wherein the payout scheme is progressive.

30. The method of claim 22 wherein the payout scheme is a predetermined payout schedule.

31. A method of playing a wagering game utilizing cards, comprising the steps of:

(a) players placing a wager consisting of a plurality of portions to participate in the game;

(b) dealing the cards such that each player receives a plurality of players cards and the dealer receives a plurality of community cards;

(c) intentionally revealing at least one additional card from the deck, disclosing the card to the players, and removing the additional card from play;

(d) allowing the player the opportunity to place a second, optional wager after viewing the revealed additional card;

(e) allowing the player to review the plurality of players cards;

(f) allowing the player the opportunity to remove a first portion of their wager based upon the reviewed players cards and the revealed additional card;

(g) revealing at least a first community card from the plurality of community cards;

(h) allowing the player the opportunity to remove a second portion of their wager based upon the reviewed players cards, the at least one revealed community card, and the revealed additional card;

(i) revealing the remaining community cards, thus creating a playing hand for each player by combining the community cards with the players cards; and (j) resolving the first wager based upon the player's playing hand and a first payment scheme and resolving the second wager based on the players hand and a second payment scheme.

32. The method of claim 31 wherein the first payment scheme is a predetermined schedule and the second payment scheme is a progressive jackpot.

33. The method of claim 31 wherein the first payout scheme is a first predetermined payout schedule and the second payout scheme is a second predetermined payout schedule.

* * * * *